US006902478B2

(12) United States Patent
McClintic

(10) Patent No.: US 6,902,478 B2
(45) **Date of Patent: *Jun. 7, 2005**

(54) METHOD AND APPARATUS FOR AN INTERACTIVE BONUS GAME

(75) Inventor: Monica A. McClintic, Boulder City, NV (US)

(73) Assignee: IGT, Reno, NV (US)

( * ) Notice: Subject to any disclaimer, the term of this patent is extended or adjusted under 35 U.S.C. 154(b) by 282 days.

This patent is subject to a terminal disclaimer.

(21) Appl. No.: 10/029,381

(22) Filed: Dec. 19, 2001

(65) Prior Publication Data

US 2003/0114219 A1 Jun. 19, 2003

(51) Int. Cl.[7] ..... A63F 9/24
(52) U.S. Cl. ..... 463/16; 463/25
(58) Field of Search ..... 463/16–29, 2, 463/40, 41, 42; 273/143 R, 138.1, 138 A

(56) References Cited

U.S. PATENT DOCUMENTS

| | | | | | |
|---|---|---|---|---|---|
| 4,582,324 | A | * | 4/1986 | Koza et al. | 463/16 |
| 4,738,451 | A | | 4/1988 | Logg | |
| 4,805,907 | A | * | 2/1989 | Hagiwara | 463/26 |

(Continued)

FOREIGN PATENT DOCUMENTS

| | | | |
|---|---|---|---|
| AU | 718243 | | 4/2000 |
| EP | 0 896 308 | | 2/1999 |
| EP | 1 253 563 | | 10/2002 |
| GB | 2062922 A | * | 5/1981 |
| GB | 2072395 A | * | 9/1981 |
| GB | 2092796 A | * | 8/1982 |
| GB | 2197974 A | * | 6/1988 |
| GB | 2226436 A | * | 6/1990 |
| GB | 2229565 A | * | 9/1990 |
| GB | 2320206 A | * | 6/1998 |
| WO | WO 98/51384 | | 11/1998 |
| WO | WO 01/33478 | | 5/2001 |

OTHER PUBLICATIONS

NBA Jam Extreme review by Games Domain [www.games-domain.com/gdreview/zones/reviews/pc/apr97/nba.html], Games's Release Date: Dec. 1996, Publisher: Acclaim, pps 1–4.

U.S. Appl. No. 10/027,888, filed Dec. 19, 2001, titled "Method and Apparatus for Gaming Machines with a Quasi–Competition Play Bonus Feature.".

Amendment, filed in regard to U.S. Appl. No. 10/027,888, dated Nov. 18, 2003.

Office Action, issue in regard to U.S. Appl. No. 10/027,888, dated Jan. 21, 2004.

*Primary Examiner*—Michael O'Neill
(74) *Attorney, Agent, or Firm*—Marshall, Gerstein & Borun LLP

(57) ABSTRACT

An interactive bonus game played in conjunction with a base game. To initiate play, a player selects a character from a list of characters in a gaming device. The player then makes a wager and plays the base game. Entry into the bonus game is achieved upon a qualification event in the base game. In the bonus game, the players have the option of modifying attributes for the selected characters. The bonus game provides the qualified player with the option to challenge another player or a computer-generated opponent in a player to player contest. A player may also be challenged by a computer-generated opponent. The challenged player then chooses whether to surrender to the qualified player or to accept the challenge. Upon acceptance of the challenge, the contest is conducted between the two players and a winner is determined, which may at least in part be affected by the attributes of the characters as modified by the players.

47 Claims, 6 Drawing Sheets

U.S. PATENT DOCUMENTS 4,856,787 A 8/1989 Itkis
4,926,327 A * 5/1990 Sidley ..... 463/13
5,159,549 A * 10/1992 Hallman et al. ..... 463/26
5,242,163 A 9/1993 Fulton
5,265,874 A 11/1993 Dickinson et al.
5,333,868 A 8/1994 Goldfarb
5,342,049 A * 8/1994 Wichinsky et al. ..... 273/119 R
5,351,970 A 10/1994 Fioretti
5,560,603 A 10/1996 Seelig et al.
5,580,308 A * 12/1996 Nakamura ..... 463/7
5,664,998 A 9/1997 Seelig et al.
5,720,663 A 2/1998 Nakatani et al.
5,769,716 A 6/1998 Saffari et al.
5,779,544 A 7/1998 Seelig et al.
5,779,549 A * 7/1998 Walker et al. ..... 463/42
5,806,045 A 9/1998 Biorge et al.
5,820,460 A 10/1998 Fulton
5,833,536 A 11/1998 Davids et al.
5,851,148 A 12/1998 Brune et al.
5,876,284 A 3/1999 Acres et al.
5,902,983 A 5/1999 Crevelt et al.
5,911,418 A 6/1999 Adams
5,947,820 A 9/1999 Morro et al.
5,951,397 A 9/1999 Dickinson
5,971,849 A * 10/1999 Falciglia ..... 463/16
6,012,982 A 1/2000 Piechowiak et al.
6,024,643 A 2/2000 Begis
6,039,648 A 3/2000 Guinn et al.
6,050,895 A * 4/2000 Luciano et al. ..... 463/7
6,142,872 A * 11/2000 Walker et al. ..... 463/16
6,146,273 A 11/2000 Olsen
6,162,122 A 12/2000 Acres et al.
6,190,255 B1 2/2001 Thomas et al.
6,193,606 B1 * 2/2001 Walker et al. ..... 463/20
6,193,607 B1 2/2001 Kay
6,203,429 B1 3/2001 Demar et al.
6,210,275 B1 4/2001 Olsen
6,234,897 B1 5/2001 Frohm et al.
6,267,669 B1 7/2001 Luciano, Jr. et al.
6,364,765 B1 * 4/2002 Walker et al. ..... 463/16
6,386,974 B1 * 5/2002 Adams ..... 463/16
6,406,369 B1 * 6/2002 Baerlocher et al. ..... 463/20
2003/0064779 A1 * 4/2003 Suda ..... 463/20
2003/0114218 A1 6/2003 McClintic

* cited by examiner

METHOD AND APPARATUS FOR AN INTERACTIVE BONUS GAME

BACKGROUND OF THE INVENTION

1. Field of the Invention

The present invention relates generally to gaming systems combining a game of chance with a bonus game. More particularly, the present invention relates to a gaming system combining a base game of chance with a bonus game, wherein the bonus game comprises an interactive contest between at least two players, at least one of which may comprise a computer-generated opponent. The games are played on gaming machines which may be at specific locations designated for play, such as a casino, or the gaming machines may be at remote locations allowing the players to play over a network. A player qualifies for entry into the bonus game in various ways, such as, for example, through a random combination of elements on the gaming machine in the base game or through a challenge from another player. Participation in the bonus game after qualification may be accepted or declined at the player's option.

2. State of the Art

Electronic games and their methods and apparatus for use are well known in the art. Electronic games include games of chance, games of skill, and games involving both skill and chance. Examples of patents describing various games of chance include U.S. Pat. No. 5,833,536 to Davids et al., U.S. Pat. No. 5,769,716 to Saffari et al., U.S. Pat. No. 5,820,460 to Fulton, and U.S. Pat. No. 5,947,820 to Morro et al.

Referring to drawing FIG. 1, illustrated is a block diagram of an exemplary prior art electronic game of chance 600. The electronic game of chance 600 typically includes a microprocessor or other similar type computer 604 having a central processing unit (CPU) 606 and any suitable type memory 608. The computer may be coupled to a number of peripheral devices such as, by example only, a display screen 610 (e.g., a cathode ray tube (CRT), plasma display, liquid crystal display (LCD), and/or a display based on light-emitting diodes (LED)), possibly having a touch screen input 612 (see U.S. Pat. No. 5,951,397 to Dickinson), and/or buttons, keys or other user input devices 614. Preferably a coin, currency or card acceptor device 616 (to accept a credit card, debit card, gaming card, smart card and the like) permits a player to activate a game play or place wagers. The electronic game may also include a separate scoreboard display 618 to indicate a player's success, or display the player's accumulated winnings. A coin or currency dispenser 630 may also be provided.

Electronic games may also be coupled to one or more other computers such as a central computer 620 of a casino, e.g., via a network card 622 and link 624, modem 626 and the like. The game parameters 628, such as how, when and where particular images will appear on the display screen 610, how the game works and how to operate the various peripheral devices coupled to the computer 604, are stored in the memory 608. Often, the electronic game 600 may be housed in a structural and/or decorative housing 602 (shown in broken lines) as is well known and understood by those of ordinary skill in the art.

As noted above, initiating an electronic game can be done as simply as by inserting a coin, token, or other type of currency. Another more comprehensive example of initiating a game includes inserting an identification card, such as a "smart card" having a programmed microchip or a magnetic strip coded with a player's identification, credit totals and other relevant information. See U.S. Pat. No. 5,265,874 to Dickinson et al., the disclosure of which is hereby incorporated by reference herein. It is also known to use a writeable identification card such as a smart card, to eliminate the need for a network or direct connection between remote systems and a common controller or point database such as is described in U.S. Pat. No. 5,806,045 to Biorge et al. Promotional point and credit information may be retrieved, recorded and updated using the smart card. Additionally, it is known to transfer money to a game through an electronic funds transfer as described in U.S. Pat. No. 5,902,983 to Crevelt et al.

In addition to the manner described above, it is also possible to participate in games of chance via the Internet. This is typically accomplished through a casino or game host site offering displays similar to those found in conventional electronic games. Generally, to play a game of chance via the Internet, a software file is downloaded to a player's computer or terminal, which may then be used to install the necessary software for the game and/or access the casino or game host Internet site. As with a conventional electronic game, Internet electronic games may be accessed using an identification code or name to identify a specific player and retrieve that player's credit total or play history.

Existing electronic game displays typically include multiple images representing various aspects of a game such as a game portion, a credit total portion and a wager amount portion. Other electronic game displays include an additional bonus award portion to indicate an amount of a bonus award which may be won, typically through multiple or secondary games. See U.S. Pat. No. 5,851,148 to Brune et al. and U.S. Pat. No. 5,911,418 to Adams.

Bonus gaming, also known in the art, includes employing a secondary game, often a different type of game than that of the base, or primary, game, as an additional activity for a player of the base game. Implementation of a bonus game includes providing a game of chance as a first or base gaming unit and adding another game through a second gaming unit. The bonus game is typically accessible upon receipt of a winning hand (in the case of a card game) or the occurrence of a specified symbol, icon, or indicia, or one or more specific combinations of the same during play of the base game. Often the existence of a bonus game serves to attract a player through the perception of having an increased opportunity to win during the player's gaming activities.

Such bonus gaming may also be conducted through a plurality of networked games such that the secondary gaming activity involves a plurality of individuals who have been wagering at base gaming units. Some examples of bonus gaming include U.S. Pat. No. 5,779,544, U.S. Pat. No. 5,664,998, and U.S. Pat. No. 5,560,603, all to Seelig et al. More particularly, some examples of bonus gaming disclosing a plurality of networked base gaming machines include U.S. Pat. No. 6,146,273 to Olsen, U.S. Pat. No. 6,012,982 to Piechowiak et al., and U.S. Pat. No. 5,876,284 to Acres et al.

As noted above, bonus games serve to entice the player to wager on a particular base game with the hope of being rewarded through the potential of increased winnings. However, the player may lose interest sooner than desired by the gaming property owner or operator because the odds of winning the bonus game are directly tied to the odds of repeatedly winning the base game. Thus, a player might eventually feel that there is no real potential of increased winnings because the odds of winning the bonus games are dependent on the play of the base games and do not change with regard to a player's participation in the bonus game.

In addition to enticing a player with the potential increased winnings of a bonus game, a bonus game that stimulates the player's mind may be useful in enticing players to a gaming machine. One example of such a machine is Ripley's Believe It or Not® slot machine game by Mikohn Gaming Corporation. The Ripley's Believe It or Not® game has a bonus feature within the game that allows the player to answer questions. The player is provided with a series of questions and four possible answers for each question. If the player answers a question correctly on the first try, then the player is awarded a bonus. If the player answers the question incorrectly on the first try and correctly on the second try, then the player is awarded a smaller bonus. This continues until the player's fourth try, at which point the player is awarded the minimum specified bonus. The player then attempts to answer the next series of questions in a similar manner. At the end of the series of questions, the player's credits are totaled. If the player's total credits exceed a minimum level, then the player may proceed to the next level of questions.

Stimulating the player's mind may also be accomplished with player interactive video games that allow the player to create a storybook environment while playing the video game. The computer devices used to create these interactive games allow the player to create a video game where the player breaks the mold of linear storytelling and participates in an epic, behavior-based story environment. The Sims video game is an example of an interactive video game where the player participates in the creation of the game. The player creates and develops the characters in The Sims, and it is the interaction of the player-controlled characters that creates the story of the game. Another example of an interactive video game is the game of Creatures. Creatures is an online interactive community video game where players "adopt" Internet creatures and care for the Internet creatures as pets. The pet's personality is dictated by how the player cares for the pet and allows the player to create the story.

Although these player-interactive video games have gained wide acceptance in modern society, these interactive games are not yet permitted within gaming venues. The obstacle faced by interactive video games in gaming venues is that the interactive games cannot be made fair to all of the players because the skill of a player becomes intertwined within the game along with the player's control of a character. The skill of one player over another may make the game unfair, and thus go against the gaming regulations. Therefore, a method of a gaming activity is needed to equalize the skills of the players in order to make such player-interactive games available for use in a regulated environment. The present invention recognizes this need and provides an interactive game which combines a game of chance with the skill of a player, yet is fair to players of all skill levels.

BRIEF SUMMARY OF THE INVENTION

The present invention provides a method and apparatus for gaming machines that provide a gaming activity that combines a game of chance, an interactive video bonus game, and the skill of a player. The gaming machines of the present invention provide a game of chance using conventional gaming technology, but include features that allow a player to incorporate his or her skills through the modification of the attributes of a character in the interactive video bonus game. Another aspect of the invention allows a plurality of players to interact and compete against each other in the bonus game through the use of a plurality of gaming machines networked together.

In one embodiment of the present invention, a bonus game is associated with a gaming machine and tied to a base game of chance. In this instance, the player begins play by playing the base game of chance. If the player receives a bonus game winning combination in the base game or is challenged by a player already qualified for the bonus game, then the player may play the bonus game. The bonus game involves challenging of a player by a challenging entity, which may comprise another player or a computer-generated opponent. A challenged player may surrender or accept the challenge, in the latter instance participating in a contest with the challenging entity.

In another embodiment of the present invention, a player selects a character and is able to modify the attributes of the selected character. Once qualified for the bonus game, the player's strategy in modifying his or her character may be a factor in the outcome of the bonus game. Thus, the player's skill in making the proper character modifications helps the player win the bonus game and allows the player to interact by helping to create the story or course of action of the bonus game. Additionally, play of the base game is employed to fund payouts for a progressive prize, as well as prizes which may be awarded to teams of players at linked gaming machines.

As used herein, the terms "game," "gaming" and "game of chance" include and encompass not only games having a random or arbitrary outcome, but also such games which also invite or require some player input to the game having at least a potential for affecting a game outcome. Such player input is generally termed "skill" whether or not such input is in actuality beneficial in terms of game outcome.

BRIEF DESCRIPTION OF THE SEVERAL VIEWS OF THE DRAWINGS

The nature of the present invention as well as other embodiments of the present invention may be more clearly understood by reference to the following detailed description of the invention, to the appended claims, and to the several drawings herein, wherein:

DETAILED DESCRIPTION OF THE INVENTION

Generally, the present invention provides new and enhanced methods and apparatus for gaming. While the present invention is described in terms of certain specific embodiments, the specific details of these embodiments are set forth in order to provide a thorough understanding of the present invention. It will be apparent, however, that the present invention may be practiced in various modifications and combinations of the specific embodiments presented herein.

Figure 1:
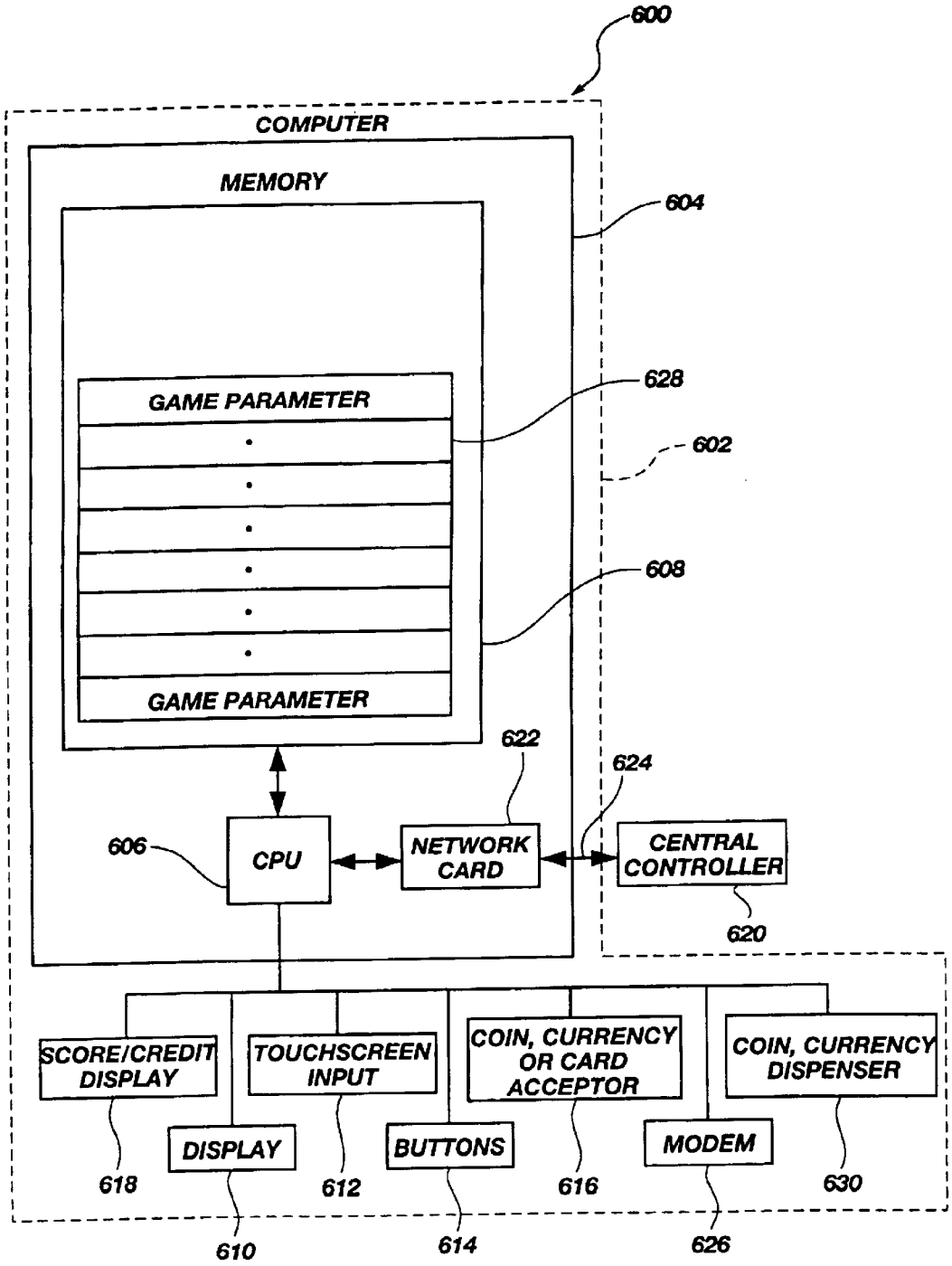
Fig. 1 (PRIOR ART)
FIG. 1 is a schematic of a conventional, prior art electronic gaming machine.
Figure 2:
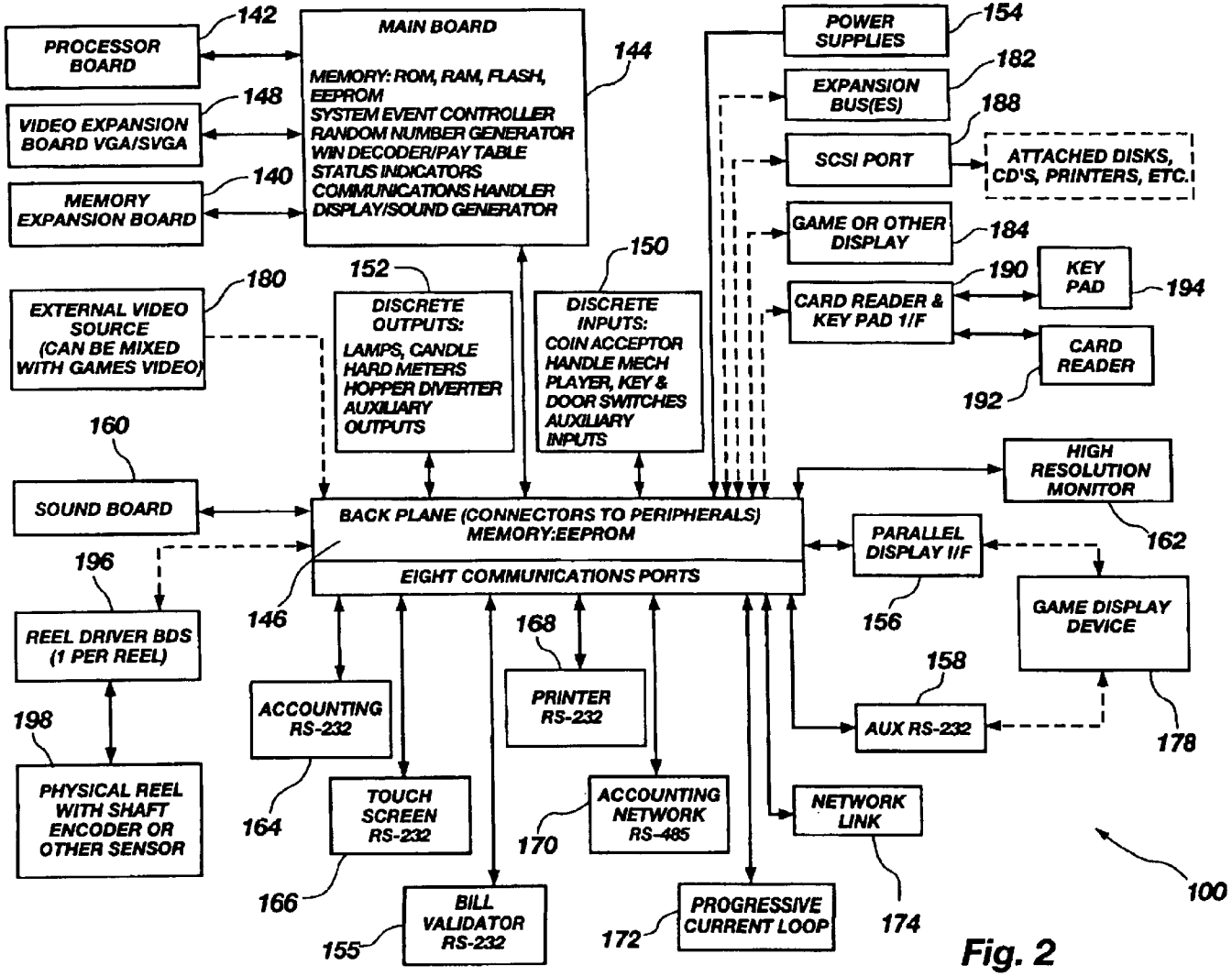
FIG. 2 is a schematic of one embodiment of the gaming machine of the present invention.

Referring to drawing FIG. 2, illustrated is a schematic diagram of a gaming machine or device 100 which may be used for the present invention. The gaming machine or device 100 disclosed herein is for exemplary purposes only. It will be appreciated to those of ordinary skill in the art that other gaming machines which perform functions the same as, or similar to, the gaming machine or device 100 described herein are also encompassed within the present invention.

FIG. 2 illustrates an exemplary gaming machine 100 for use in implementing the bonus game of the present invention. Gaming machine or device 100 includes a memory board 140, a processor board 142, a main board 144 and a back plane 146 integrally or separately formed. Memory expansion board 140 as well as processor board 142 including a graphics system processor and video expansion board VGA/SVGA 148, are operably coupled to the main board 144. The main board 144 preferably includes memory in the form of ROM, RAM, flash memory and EEPROM (electrically erasable programmable read only memory). In addition, the main board 144 includes a system event controller, a random number generator, a win decoder/pay table, status indicators, a communications handler and a display/sound generator.

The main board 144 is operably coupled to the back plane 146, which may include additional memory, such as in the form of an EEPROM, and connectors to connect to peripherals. Furthermore, the back plane 146 provides a plurality of communication ports for communicating with external peripherals. The back plane 146 provides the coupling between discrete inputs 150 and the processor board 142 and main board 144. Typical examples of elements which provide discrete inputs 150 are coin acceptors, game buttons, mechanical hand levers, key and door switches and other auxiliary inputs. Furthermore, the back plane 146 provides the coupling between discrete outputs 152 and the processor and main board 144. Typically and by way of example only, elements that provide discrete outputs 152 are in the form of lamps, hard meters, hoppers, diverters and other auxiliary outputs.

The back plane 146 also provides connectors for at least one power supply 154 for supplying power for the processor board 142 and a parallel display interface (PDI) 156 and a serial interface 158 for game display device 178. In addition, the back plane 146 also provides connectors for a sound-board 160 and a high-resolution monitor 162. Furthermore, the back plane 146 includes communication ports for operably coupling and communicating with an accounting network 164, a touch screen 166 (which may also serve as a game display device), a bill validator 155 incorporated in a currency (bill) acceptor, a printer 168, an accounting network 170, a progressive current loop 172 and a network link 174.

The back plane 146 optionally includes connectors for external video sources 180, expansion buses 182, game or other displays 184, an SCSI port 188 and an interface 190 for at least one card reader 192 (debit/credit, player card, etc.) and key pad 194. The back plane 146 may also include means for coupling a plurality of reel driver boards 196 (one per reel) which drive physical game reels 198 with a shaft encoder or other sensor means to the processor board 142 and main board 144 if a gaming device 100 is configured for play of a reel-type game. Of course, the reels may be similarly implemented electronically by display as video images, technology for such an approach being well known and widely employed in the art. In such an instance reel driver boards 196 and physical game reels 198 with associated hardware are eliminated and the game outcome generated by the random number generator on main board 144 is directly displayed on a video game display 184 and, optionally, on a separate game display device 178, as known in the art. Other gaming machine configurations for play of different wagering games such as video poker games, video blackjack games, video Keno, video bingo or any other suitable primary games are equally well known in the art. It will also be understood and appreciated by those of ordinary skill in the art that selected components of gaming device 100 may be duplicated for play of a bonus game or event in accordance with the present invention, in that at least a separate board with a second random number generator may be employed, with associated peripherals and links thereto, for play of the bonus game. In the conventional situation wherein the bonus game of the present invention may be operably coupled as a "top box" or otherwise associated with a conventional, existing gaming machine configured for play of a base game, many of the components illustrated in FIG. 2 and described with respect thereto will be duplicated, including separate software and associated memory for conducting play of the bonus game with associated pay tables for the bonus awards.

Gaming machine 100 may be used to play the base game that activates the bonus game of the present invention and as a terminal for play of the bonus game. This gaming machine 100 may be configured as a reel-type gaming machine, a video gaming machine that simulates reels or enables play of a card game, or any other type of mechanical or electronic gaming device known in the art for play of the primary game.

Figure 3:
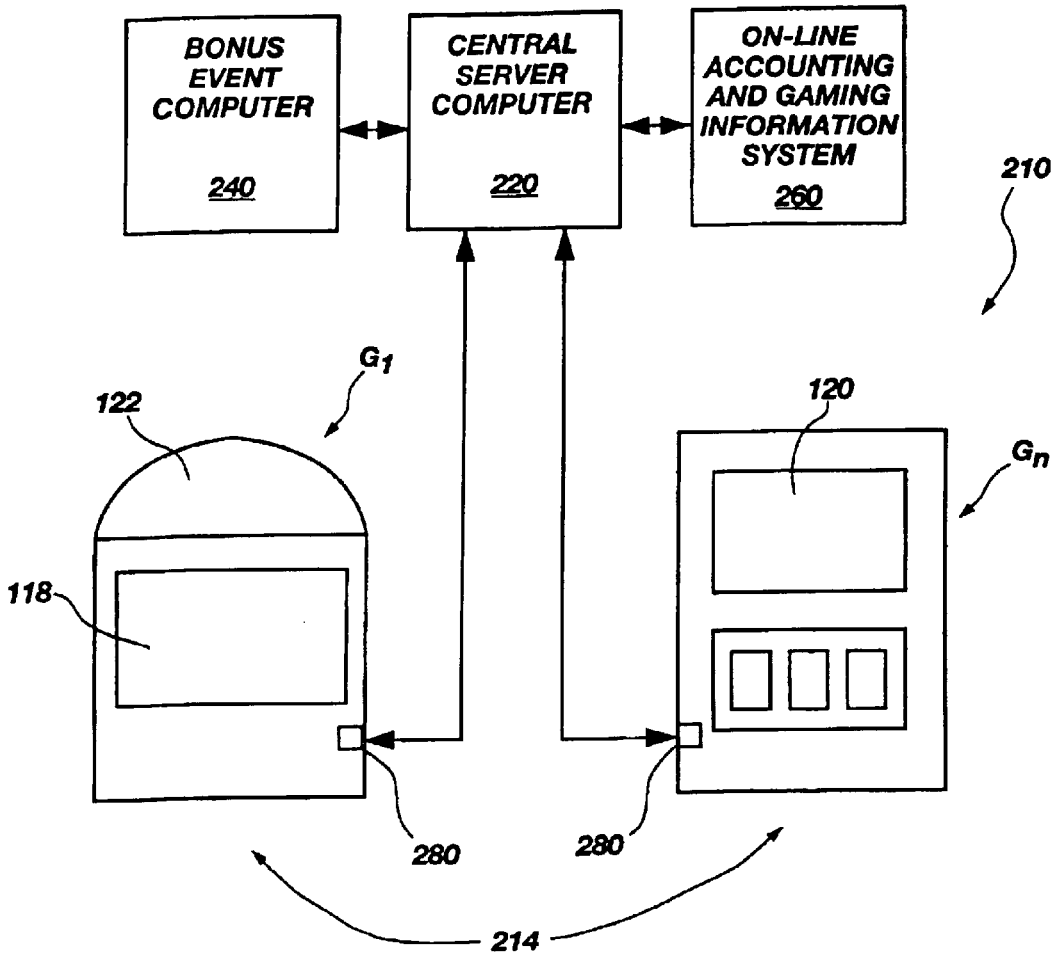
FIG. 3 is a schematic of networked gaming machines of the present invention.

In implementation of the present invention, the gaming machines offering play of the bonus event of the present invention may be deployed, as schematically depicted in FIG. 3, in a gaming network 210 including a central server computer 220 operably coupled to a bank 214 or other plurality of gaming machine $G_1$, $G_2$ . . . $G_n$ which may include both electronic and reel type game machines and which may be configured, by way of example only, as gaming machines 100. It is notable that, unless the gaming network 210 is configured for progressive play, a variety of different makes of gaming machines $G_1$, $G_2$ . . . $G_n$ offering widely different games may incorporated in gaming network 210, since the bonus event operates independently of the primary game on each gaming. The central server computer 220 automatically interacts with a plurality of gaming machines $G_1$, $G_2$ . . . $G_n$ to activate a bonus event.

More specifically, and again referring to FIGS. 2 and 3, the gaming network 210, which may comprise a competitive bonus gaming network, includes a central server computer 220, a bonus event computer 240 and a plurality of gaming machines $G_1$, $G_2$ . . . $G_n$. Each gaming machine $G_1$, $G_2$ . . . $G_n$ includes a controller assembly 280 operably coupled to the central server computer 220 and is comprised of a controller unit designed to facilitate transmission of signals from each individual gaming machine $G_1$, $G_2$ . . . $G_n$ to central server computer 220 for monitoring purposes. In addition, the controller assembly 280 includes a network interface board fitted with appropriate electronics for each specific make and model of each individual gaming machine $G_1$, $G_2$ . . . $G_n$.

Referring to FIG. 3, in electronic video games, the central server computer 220 is operably coupled to at least one video game display element 118 as shown at the left hand side of FIG. 3 and sequesters a portion of the video game display element 118 for displaying video attract sequences to attract potential players. Video game display element 118 may be used for display of both the primary and bonus games. Where the gaming network 210 includes reel type game machines $G_1$, $G_2$ . . . $G_n$, as shown at the right hand side of FIG. 2, the central server computer 220 may be operably coupled to at least one active display element 120 so that potential players receive a clear indication of attract sequences and the active display element 120 may be used as a video display for the bonus game. As shown at the left hand side of FIG. 2, the gaming machines $G_1$, $G_2$ . . . $G_n$ may also be provided with a second video display element 122 as an alternative to sequestering a portion of the video game display element 118 for displaying video attract sequences and the bonus game. In addition, the central server computer 220 may include sound generating hardware and software for producing attractive sounds orchestrated with the video attract sequences at each of gaming machines $G_1$, $G_2$ . . . $G_n$ if such is not already incorporated therein. The games support input and output between the player and the game for such devices as heads up display, joystick, keyboard, mouse and data glove via interface modules connected through the expansion bus or buses 182 and SCSI port 188.

The attractive multimedia video displays and dynamic sounds may be provided by the central server computer 220 by using multimedia extensions to allow gaming machines $G_1$, $G_2$ . . . $G_n$ to display full-motion video animation with sound to attract players to the machines. During idle periods, the gaming machines $G_1$, $G_2$ . . . $G_n$ preferably display a sequence of attraction messages in sight and sound. The videos may also be used to market specific areas of the casino and may be customized to any informational needs.

Furthermore, the gaming network 210 includes bonus event computer 240 operably coupled to the central server computer 220 for scheduling bonus parameters such as the type of bonus game, pay tables and players. The functions of central server computer 220 and bonus event computer 240 may, of course, be combined in a single computer. The bonus game may be conducted solely on the bonus event computer 240 and visible manifestations of the bonus game, including the final outcome thereof, are displayed as video images on high resolution monitor 162, game display device 178, or at least one bonus game display 236. Preferably, the gaming network 210 further includes a real-time or on-line accounting and gaming information system 260 operably coupled to the central server computer 220. The accounting and gaming information system 260 includes a player database for storing player profiles, a player tracking module for tracking players and a pit, cage and credit system for providing automated casino transactions.

As previously implied, a bank of gaming machines $G_1$, $G_2$ . . . $G_n$ may be networked together in a progressive configuration, as known in the art, wherein a portion of each wager used to initiate the primary game may be allocated to bonus awards or bonus pools. The bonus pool may also comprise a predetermined, fixed number of credits that are added for each qualifying entry. In addition, and referring to FIG. 4, a host site computer 320 is coupled to a plurality of the central server computers 220 at a variety of remote gaming sites $C_1$, $C_2$ . . . $C_n$ for providing a multi-site linked automated bonus gaming system 310 which, optionally, may be configured for progressive play.

Preferably, the host site computer 320 will be maintained for the overall operation and control of the system 310. The host site computer 320 includes a computer network 322 and a communication link 324 provided with a high-speed, secure modem link for each individual casino site $C_1$, $C_2$ . . . $C_n$.

Each casino or other gaming site $C_1$, $C_2$ . . . $C_n$ includes the central server computer 220 provided with a network controller 230 which includes a high-speed modem operably coupled thereto. Bidirectional communication between the host site computer 320 and each casino site central server 220 is accomplished by the set of modems transferring data over communication link 324.

A network controller 230, a bank controller 232 and a communication link 234 are interposed between each central server 220 and the plurality of networked gaming machines at each casino site $C_1$, $C_2$ . . . $C_n$. In addition, the network controller 230, the bank controller 232 and the communication link 234 may optionally be interposed between each central server computer 220 and at least one separate bonus game display 236 at each casino site $C_1$, $C_2$ . . . $C_n$. Moreover, the system 310 may include hardware and software to loop back data for in-machine meter displays to communicate with bonus event award insert areas on gaming machines $G_1$, $G_2$ . . . $G_n$.

By way of exemplary implementation of the present invention, the bank 214 of gaming machines $G_1$, $G_2$ . . . $G_n$ may be connected or linked to form a competitive bonus gaming network 210. The bank 214 of gaming machines $G_1$, $G_2$ . . . $G_n$ may also be connected or linked to the at least one bonus game display 236. The bank 214 of gaming machines are represented in FIG. 2 as $G_1$ through $G_n$, where $G_1$ is depicted as an electronic slot machine and $G_n$ is depicted as a reel-type slot machine. Although only two, networked gaming machines are illustrated in FIG. 2, it will be readily apparent to one of ordinary skill in the art that any number of gaming machines $G_1$, $G_2$ . . . $G_n$ may be used in the present invention. For example, in a preferred embodiment, the bank 214 of gaming machines may comprise eight or more gaming machines $G_1$, $G_2$ . . . $G_n$, where "n" equals at least eight, connected or linked together.

Bonus game display 236 may be configured as a relatively large, liquid crystal display ("LCD") screen or a plurality of such screens. The screen(s) is/are relatively large in comparison to the high resolution monitor 162 or other game display device 178 of gaming machine 100. The bonus game display(s) 236 may be positioned in an area above the gaming machines $G_1$, $G_2$ . . . $G_n$ so that the screen(s) is/are visible to all players at the bank of gaming machines $G_1$, $G_2$ . . . $G_n$. Bonus game display 236 may comprise other types of display screens known in the art including cathode ray tube (CRT) screens, plasma display screens, and/or screens based on light emitting diode (LED) technology. Bonus game display 236 may be a display screen configured for multiple uses and/or concurrent display of other casino-sponsored information. For example, bonus game display 236 may be used in association with a Sports Book venue of the casino during periods in which bonus game display 236 is temporarily not used for the purposes of the present invention.

Gaming machines $G_1$, $G_2$ . . . $G_n$ may be connected to bonus game display 236 through communication link 234. Communication link 234 may be any of a variety of communication links known in the art, including, but not limited to: twisted-pair wire, coaxial cable, fiber optic, Ethernet, token ring, bus line, Fibre Channel, ATM, standard serial connections, LAN, WAN, Intranet, Internet, radio waves, or other wireless connections.

It will be appreciated by those of ordinary skill in the art that another embodiment may employ some or all gaming machines $G_1$, $G_2$ . . . $G_n$ in the form of personal computers located at sites remote from the host site computer 320. The personal computers may be located in homes, businesses or other locations remote from the host site computer 320, such as a casino site $C_1$, $C_2$ . . . $C_n$. In this embodiment, the personal computers are configured such that the personal computer may connect to host site computer 320 through a network, such as the Internet. The personal computers are enabled to participate in gaming activities by downloading software, wherein the software provides access to the gaming activities and configures the personal computer for play of the gaming activity. The games are preferably conducted and controlled from the host site computer 320.

Figure 4:
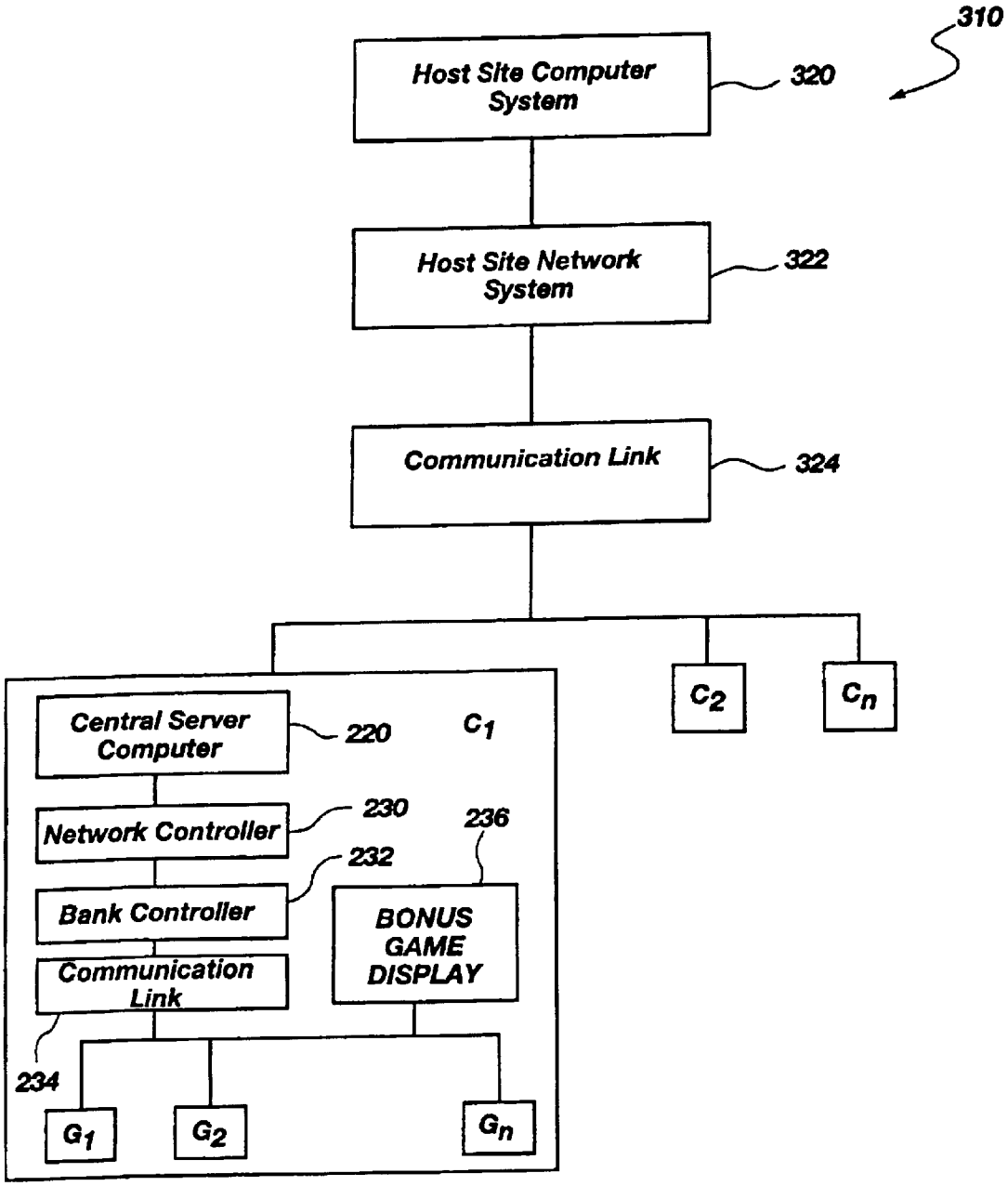
FIG. 4 is a diagram of the cooperative and competitive bonus gaming system of the present invention.

Referring to drawing FIGS. 3 and 4, a cooperative and competitive bonus gaming network 210 may include a central server computer 220 operatively coupled to a plurality of gaming machines $G_1$, $G_2$ . . . $G_n$ which may include both electronic and reel type game machines. The game machines $G_1$, $G_2$ . . . $G_n$ used may be of the type described with reference to drawing FIG. 2. The central server computer 220 automatically harnesses the multiplicity of gaming machines $G_1$, $G_2$ . . . $G_n$ to activate a bonus event where bonus event participant(s) are selected from a group of players to participate in the bonus event where prizes may be awarded to the winning bonus play participant(s). It will appreciated by those of ordinary skill in the art, that implementation of the bonus event, or game, may be accomplished by configuring the individual gaming machines $G_1$, $G_2$ . . . $G_n$, the bonus event computer 240, or both to conduct the bonus game. In addition, and referring to drawing FIG. 4, a multi-site progressive automated bonus gaming system 310 may include a host site computer 320 coupled to a plurality of the central server computers 220 at a variety of remote gaming sites $C_1$, $C_2$ . . . $C_n$.

It will be appreciated by those of ordinary skill in the art that the gaming devices and networks described above may be configured, in the form of suitable software programs, to conduct the gaming activities described herein. Referring to drawing FIG. 5, a method of gaming, including conducting a wagering event and qualification for a bonus game associated therewith is illustrated. The method described herein may be implemented on an exemplary individual gaming machine or device 100 or may be implemented on a plurality of networked gaming machines $G_1$, $G_2$ . . . $G_n$. The plurality of gaming machines $G_1$, $G_2$ . . . $G_n$ may be associated in a bank at the same location or distributed at remote locations, linked together and monitored by one or more central server computers 220 (See FIG. 3.) through a gaming network 210. Additionally, the method of gaming described herein may be implemented through a multi-site gaming system 310 as previously described.

Figure 5:
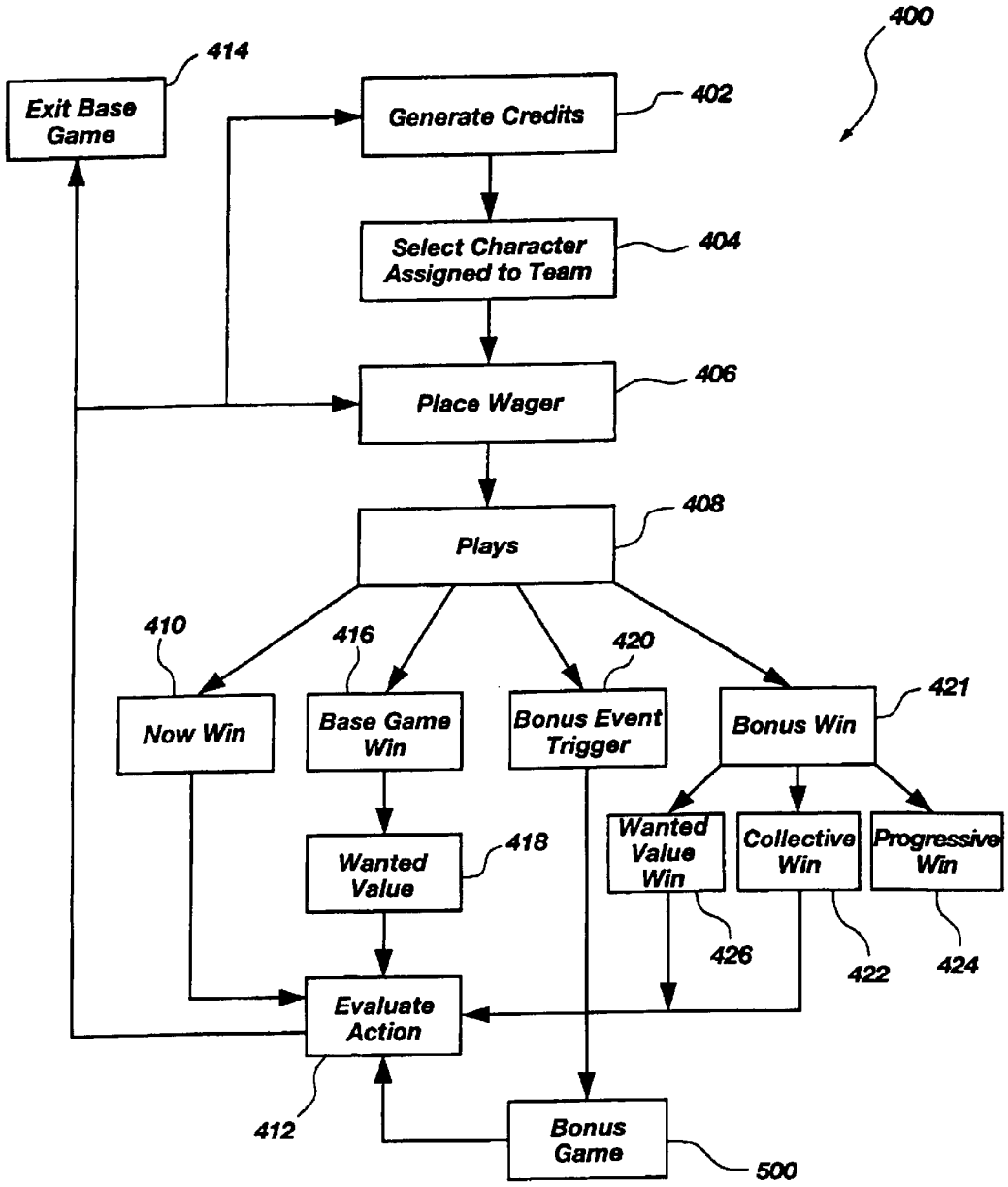
FIG. 5 is a flowchart diagramming play of the base game of the present invention.

According to an exemplary embodiment of the invention and referring to drawing FIG. 5, a bonus event qualification is incorporated within a base or primary gaming unit such as a reel type gaming machine or a video card (Poker, Blackjack, etc.) gaming machine, exemplified by gaming machine 100. In the exemplary bonus event embodiment of the present invention, the method of gaming described herein is implemented according to a Western theme. For example, characters in the Western theme may be designated as outlaws, with appropriate associated names and histories, the theme being competition according to a "Wanted Dead or Alive" theme in the form of gunfights between various outlaws for bonus awards. Additionally, the gaming machine 100 may be desirably configured such that the video and audio effects, including the base game and attract sequences produced by the gaming machine 100, follow a Western motif. To initiate play, a player generates credits 402 in the gaming machine 100 for play of the base game. The credits 402 may be generated from cash input, such as a coin or bill, by decrementing credits from a credit card, debit card or player card or by any other method of generating credits 402 into a gaming device 100 known to those of ordinary skill in the art. After generating credits 402, a character generation sequence 404 is initiated.

In the character generation sequence 404, the player is prompted to select a character from a library of characters and, optionally, associating a chosen character with the player's profile. If the player fails to choose a character, one will be randomly assigned to him or her. The gaming machine 100 used to implement the present gaming method may be in communication with a real-time or on-line accounting and gaming information system 260 accessed, for example, via accounting network 170 (shown in FIG. 2) RS-485 connection and wherein are stored the library of characters and player profiles. Additionally, each character is assigned a "wanted" value, characterized as a monetary value as was employed in period Western "Wanted Dead or Alive" posters. After the player selects his or her character, the selected character may be assigned to a team 404 by the gaming machine or device 100. The player uses the same character throughout play of the game until the player exits 414 the base game 400. Upon exiting 414 the base game 400, the credits due the player are calculated and dispensed to the player in any manner known to those of ordinary skill in the art. After the player has chosen a character and (optionally) been placed on the team 404, the player proceeds to play the base game 400.

The player places a wager 406 in the base game 400 by betting a number of credits, which bet may be set at a level higher than a minimum level for base game play in order to qualify for eventual entry into the bonus game. After placing the wager 406, the player proceeds to play 408 the base game 400. In the illustrated embodiment of the present invention, the base game 400 is a game of chance, such as a reel-type game machine. However, and as noted above, the base game 400 may also be a card game machine or any other suitable base game 400 known to those of ordinary skill in the art. The results of the base game 400 are randomly determined by the gaming machine 100 (if a reel-type base game) and displayed to the player. If no winning combination 410 is generated, the credits wagered 406 by the player are deducted. The player then evaluates the next action 412 to take. In the evaluate action step 412, the player has the option to cash out and exit 414 the base game 400, place another wager 406 or generate more credits 402. If the player cashes out and exits 414, the credits due the player are calculated and dispensed to the player.

A variety of winning combinations may also be achieved by the player in base game play including, but not limited to, a base game win 416, a bonus event trigger 420 or a bonus win 421. If the player achieves a base game winning combination 416, then the player's credits are updated in accordance with an associated pay table value, the player's character wanted value 418 is increased and the player evaluates 412 which action to take next.

Potential bonus wins 421 in base game play include a wanted value win 426, a collective win 422, or a progressive win 424. Bonus wins may comprise separate wins or a combination of wins, for example a combined wanted value win 426 and collective win 422. During play of the base game, a percentage of the wagers or of winnings of all the players associated with play of the base game 400 at the networked gaming machines may be used to fund a collective bonus pool and a progressive bonus pool. If the bonus win 421 which includes an associated wanted value win 426 is achieved by the player, then (as noted above) the player wins an amount of credits proportional to his or her character's wanted value at the time of the wanted value win 426 and based on a pay table.

If a collective win 422 in base game play is achieved by any player, the then-active players on the collective winning player's team receive credits according to a predetermined pay table. If player tracking technology is employed, a player on a team wherein the collective win is triggered in his or her absence from active may remain eligible for the collective bonus payout for a selected period of time, for example based on total base game wagers placed. If a progressive win 424 in base game play is achieved by any player, then that player's credits are updated and the gaming machine 100 is locked and an operator is notified to confirm the progressive prize award.

Figure 6:
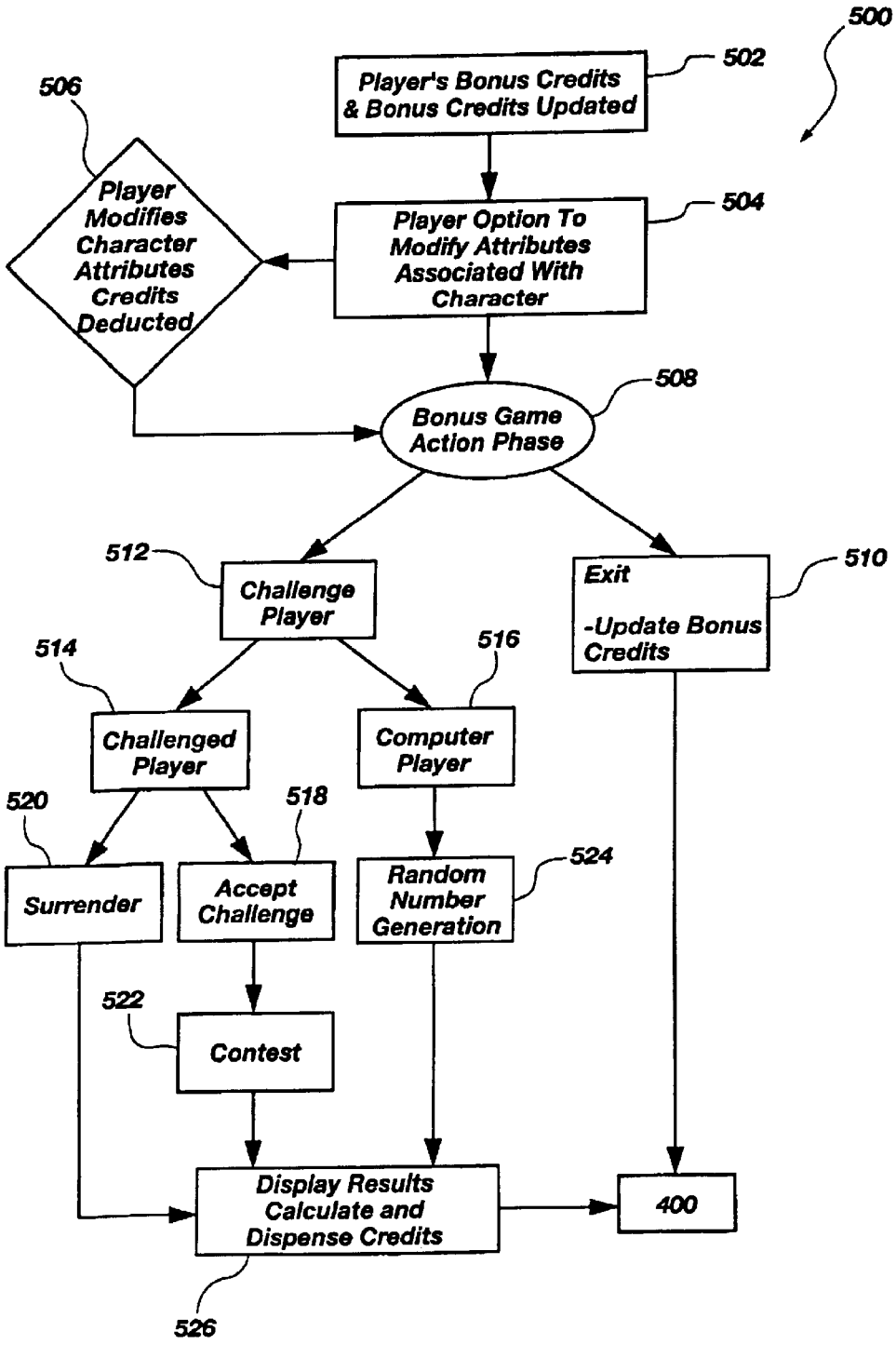
FIG. 6 is a flowchart diagramming play of the bonus game of the present invention.

If a bonus event trigger 420 is achieved in base game play, then the player in question is qualified to play a bonus game 500. Notably, a bonus event trigger 420 may result from a certain outcome of base game play or, to enhance the entertainment value of the gaming experience, may be triggered randomly over time at various active gaming machines 100. Referring now to drawing FIG. 6, illustrated is a flow chart of the sequence of bonus game 500. Upon entry into the bonus game 500, the player's credits are increased 502 in accordance with a predetermined pay table, and his team's credits may also be increased. Upon achieving the bonus event trigger 420, the gaming machine 100 selects the player to enter the "Wanted Dead or Alive" bonus event and notifies the player with a message informing the player that he or she has been chosen to enter the bonus game 500. For example, the notification may comprise a concurrent text and audio message such as "Strap on your shootin' iron, pardner, you've been called out by Black Bart" if the bonus event trigger 420 results in a challenge from a computer-generated opponent, or "There's only room for one top gun in this town. Looks like you're going to have to call that varmint out" if the bonus event trigger 420 is one enabling a challenge of another player or computer-generated opponent.

The bonus game 500 provides, as part of an interactive video gaming experience for the player, an opportunity to modify attributes for the player's previously chosen character 504. The attributes associated with the player's character may include skills, abilities or other traits that the character possesses, or a favorable change in the environment of the gunfight. Attributes are randomly assigned to each character upon initiation of the base game 400 and may be modified by a player of the base game 400 at the time of entry into the bonus game. For example, a player may be provided the opportunity to modify his or her character with sharper eyesight, faster reflexes, a second pistol, more bullets for his pistol, or a hidden derringer. Alternatively, or in addition to these character modifications, a player may favorably modify the gunfight environment by, for example, securing the sun at his or her back, wind blowing dust toward the opponent, etc. The player may be enabled to enhance the attributes of the player's character by purchasing the opportunity to modify the character's attributes by spending credits 506. The modification of the character's or the environment's attributes creates a unique gaming experience, wherein the player's modifications may determine, at least in part, events that unfold in the course of bonus game 500 by altering the game sequence as displayed on bonus game display 236. Additionally, the character's or environment's attributes may be a factor, at least in part, in the final outcome of the bonus game 500. Notably, when two players or a player and a computer-generated opponent engage in a gunfight contest, some seeming advantages may be actually transformed into disadvantages, depending on the attributes of the opposing character.

Once the player has modified his or her character's or the environment's attributes or alternatively has chosen not to modify the player's character, the player makes strategic decisions in a bonus game action phase 508. In the action phase 508, the player may choose to use exit 510 from the bonus game 500 to exit the game or may choose to challenge another player 512. If the player uses exit 510 from the bonus game 500, then the player may bank the credits earned for being chosen to play the bonus game 500 and return to the evaluate action step 412 of the base game 400.

As noted above, the player also has the option of challenging another player 512. The player may challenge another player of the base game 514 (a "challenged" player) or a computer-generated opponent 516. If the player challenges another player 514 of the base game 400, then the challenged player 514 has the option of accepting the challenge 518 or surrendering 520. If the challenged player 514 surrenders 520, then the bonus game ends 500. Credits of the challenged player's wanted value are deducted and added to the challenging player, wherein the results are displayed to the players 526. If the challenged player accepts the challenge 518, a contest 522 in the form of a gunfight is conducted between the two players. The outcome of contest 522 may be determined, at least in part, based on the attributes of the character. It is contemplated that, as noted above, a bonus trigger event 420 may also result in a challenge to the player by a challenging entity in the form of a computer-generated opponent. Such a feature may be programmed into the game architecture to occur randomly over time when, for example, few bonus trigger events 420 enabling a player to challenge are occurring so as to maintain and stimulate player interest.

At the least, the course of each gunfight may be altered for entertainment value based on the attributes of the two contestants or the environment so that no two gunfights follow the same course of action. In such an instance, the outcome of the gunfight may be completely randomly determined. Alternatively, the attributes may be used to positively or negatively affect the contest outcome for a player. Therefore, a player may be enabled to select a game strategy which may, depending upon the game architecture, either perceptibly or actually alter the course and even the outcome of a gunfight, by modifying the attributes of his or her character. Additionally, each player's wanted value changes based on the outcome of the contest 522.

If the challenging player challenges the computer-generated opponent 516, a random number is generated 524 and determines the outcome between the player and the computer player in the same manner as previously described. If a player is challenged by the computer, for example in the context of the above-noted randomly-timed bonus event trigger 420, the player may again choose to accept the challenge or surrender. In any instance of surrender by a player, credits are deducted from the surrendering player's wanted value. In both the player-to-player and player-to-computer-generated opponent challenges, the contest results are displayed to the players and credits are dispensed to the players in accordance with the outcomes of the contests 526 according to pay tables, thus ending the bonus game 500.

The gaming activity described herein keeps the game substantially fair because the game architecture may be established to limit each entry to the bonus game 500 to a single challenge and then return the participating player or players back to the base game 400. The overall pay table for the base game and bonus game in combination may be controlled to maintain a required percentage pay out in accordance with governmental regulations as in conventional wide area progressive (WAP) gaming systems exemplified by the WHEEL OF FORTUNE® progressive offered in the state of Nevada, United States of America. Additionally, the bonus game 500 may be determined, at least in part, by random number generation 524. The generation of the random number helps keep the game fair to all players regardless of skill level, yet may be used in combination with character and environmental attributes to enable the strategy of the players to become a factor wherein players may potentially earn more credits under selected circumstances. The credits dispensed to a victorious player may be banked so as to not be placed at risk in a future challenge, used to play again immediately or stored for future play of the base game 400.

While disclosed in the context of a gunfight contest between outlaws, it is contemplated that the bonus game of the present invention may be characterized as a contest between an outlaw and a representative of the law, for example a sheriff, a U.S. Marshal, a Texas Ranger, a bounty hunter, etc. Teams may be assembled along the same lines, with one team being characterized as a "posse" competing against a "gang" of outlaws.

It is further contemplated that the bonus game of the present invention may be implemented in the form of other familiar contests from various historical periods. For example, the bonus game may be implemented as a series of jousts between knights in a mediaeval tournament, between members of two Prohibition-era Chicago gangs or between "G-men" and gang members, or between gladiators in a Roman arena.

Although the present invention has been shown and described with respect to illustrated embodiments, various additions, deletions and modifications that are obvious to a person of ordinary skill in the art to which the invention pertains, even if not shown or specifically described herein, are deemed to lie within the scope of the invention as encompassed by the following claims.

What is claimed is:

1. A gaming method comprising:

providing at least one player an opportunity to play a base game;

generating an outcome from the play of the base game by the at least one player;

qualifying the at least one player for participation in a bonus game, said qualifying dependent on the outcome from play of the base game; and providing a player qualifying for the bonus game an opportunity for one of participating in the bonus game and returning to the base game, the participating in the bonus game by a player qualifying for the bonus game including at least one player of the base game enabled to participate in a contest including a challenge of at least one player by a challenging entity; and providing the at least one challenged player with an opportunity of one of accepting the challenge or surrendering to the challenge such that accepting of the challenge to play comprises conducting the contest between said at least one player and the another player and awarding credits to a winner of the contest and surrendering to the challenge comprises deducting credits from the surrendering player and awarding said credits to the challenging entity.

2. The method of claim 1, wherein qualifying for participation in the bonus game includes the at least one player obtaining a selected outcome from the base game.

3. The method of claim 1, further comprising:

providing the at least one player playing the base game an opportunity to select a character for bonus game play from a plurality of characters; and the at least one player selecting a character from the plurality of characters.

4. The method of claim 3, further comprising:

assigning the character selected by said at least one player to a team comprised of a plurality of players.

5. The method of claim 3, further comprising:

providing each of the plurality of characters with at least one associated attribute, the at least one associated attribute for the each of the characters being modifiable.

6. The method of claim 5, wherein the at least one associated attribute for the selected character includes an associated attribute comprising at least one factor for determining at least one of at least a portion of a course of action of the bonus game and at least a portion of an outcome of the bonus game.

7. The method of claim 5, wherein the at least one player selecting the character is enabled to purchase an opportunity for modifying the at least one associated attribute for the character.

8. The method of claim 1, further comprising at least one of the base game generating a winning outcome and awarding credits to the at least one player and the base game not generating a winning outcome and deducting credits from the at least one player.

9. The method of claim 1, wherein the at least one challenged player is either a player of the base game or a computer-generated player.

10. The method of claim 1, wherein the contest comprises determining a winner based at least in part on a result of a random number being generated.

11. The method of claim 1, further comprising:

playing the base game and the bonus game on a gaming machine.

12. The method of claim 11, further comprising:

networking together a plurality of gaming machines for playing the bonus game such that at least two players at different gaming machines may play the bonus game.

13. The method of claim 12, further comprising:

converting the gaming machine from a first mode of operation for playing the base game to a second mode of operation for playing the bonus game.

14. The method of claim 13, further comprising administering the bonus game from a location other than any of the gaming machines.

15. The method of claim 1, further comprising:

providing a plurality of gaming machines, each gaming machine convertible between the play of the base game in a first mode of operation and the play of the bonus game in a second mode of operation;

the at least one player qualifying for play in the bonus game through play of the base game in the first mode of operation from any one of the gaming machines of the plurality; and the at least one player playing the bonus game on at least one gaming machine of the plurality after the conversion thereof to the second mode of operation.

16. The method of claim 1, wherein the base game comprises a game of chance.

17. The method of claim 16, wherein the base game is selected from a reel-type slot machine game and a video card game.

18. The method of claim 1, further comprising:

providing the at least one player an opportunity to place a wager for play of the base game.

19. The method of claim 5, further comprising:

storing information about the associated attributes for the characters.

20. The method of claim 11, further comprising:

conducting the bonus game according to a Western theme on the gaming machine.

21. The method of claim 20, further comprising:

providing the at least one player with a wanted value associated with the bonus game; and providing at least one other player an opportunity to win a reward in bonus game play related to the wanted value, the opportunity to win the reward being related to an outcome of play of the base game.

22. A gaming apparatus, comprising:

a base gaming unit enabling a first mode of operation for playing a base game and generating an outcome therefor a bonus gaming unit operably coupled to the base gaming unit and enabling a second mode of operation for playing a bonus game responsive to at least one outcome of the base game, the bonus game comprising an opportunity for one of participating in the bonus game and returning to the base game, the bonus game comprising a first player challenging at least one other player to a contest, the bonus game further providing the at least one other player with at least one of an opportunity for accepting a challenge by the first player or surrendering to the first player, the first player accepting the challenge followed by conduct of a contest between the first player and the at least one other player and awarding credits to a winner of the contest, the at least one other player surrendering followed by having credits deducted from a value associated with the at least one other player and awarded to the first player.

23. The gaming apparatus of claim 22, further comprising:

a display operably coupled to the base gaming unit, the display for exhibiting at least one outcome of the base game and for exhibiting the results of the contest.

24. The gaming apparatus of claim 22, further comprising:

a microprocessor associated with the base gaming unit for generating at least one outcome of the base game.

25. The gaming apparatus of claim 23, further comprising:

a microprocessor associated with the bonus gaming unit for conducting the contest.

26. The gaming apparatus of claim 23, further comprising:

at least one other base gaming unit operably coupled to the base gaming unit over a network.

27. The gaming apparatus of claim 25, wherein the base gaming unit and the at least one other base gaming unit are located in at least two mutually remote locations.

28. The gaming apparatus of claim 22, wherein the bonus gaming unit is configured to initiate the bonus game responsive to at least one play of the base game.

29. The gaming apparatus of claim 22, wherein the bonus gaming unit is configured to enable bonus game play between players at two gaming machines.

30. The gaming apparatus of claim 22, further including a communication link to at least one other base gaming unit.

31. The gaming apparatus of claim 22, further comprising a display for displaying a course of action and an outcome of a conducted contest.

32. The gaming apparatus of claim 22, further comprising a display for displaying values associated with players at a plurality of base gaming units.

33. The gaming apparatus of claim 22, further comprising:

a computer separate from and operably coupled to the base gaming unit and the bonus gaming unit for administering the bonus game.

34. The gaming apparatus of claim 22, wherein the bonus game further comprises enabling at least one player playing the base game to select a character from a plurality of characters, at least one of assigning a selected character to a team and providing each of the plurality of characters with at least one associated attribute, the at least one associated attribute for each character being subject to modification by the at least one player selecting that character.

35. The gaming apparatus of claim 34, further comprising:

a storage system for storing modified associated attributes for a selected character after modification by the at least one player.

36. A gaming system, comprising:

at least one gaming machine including:

at least one base gaming unit for generating an outcome from play of a base game and enabling qualification for play of a bonus game;

at least one bonus game unit operably coupled to the at least one base gaming unit for administering the bonus game to at least one qualified player, the bonus game including providing a qualified player at least one of an opportunity to participate in the bonus game and return to play of the base game, the participation in the bonus game including challenging at least one player to a contest, the bonus game further providing the at least one player an opportunity of at least one of accepting the challenge and surrendering in response to the challenge, the at least one player having credits awarded by accepting the challenge and winning the contest, the at least one player having credits deducted and awarded to a challenging entity by surrendering.

37. The gaming system of claim 36, wherein the bonus game unit is configured for conducting the contest from a remote location.

38. The gaming system of claim 36, comprising a plurality of gaming machines operably coupled to the bonus game unit.

39. The gaming system of claim 38, wherein each gaming machine is operably coupled to the bonus game unit from a location remote therefrom.

40. The gaming system of claim 38, wherein at least two of the gaming machines are mutually remotely located.

41. The gaming system of claim 40, wherein the at least two gaming machines are remotely located from at least one other gaming machine of the plurality of gaming machines.

42. The gaming system of claim 38, wherein the bonus game unit gaming machines of the plurality is configured to conduct the bonus game using a computer at a location remote from at least some of the gaming machines of the plurality through a telecommunications link.

43. The gaming system of claim 42, wherein the bonus game unit outputs data to the computer.

44. The gaming system of claim 36, wherein the gaming machine includes at least one microprocessor for generating the outcome of the base game and enabling participation in the bonus game.

45. A gaming system comprising:

at least one gaming machine configured for generating an outcome for a base game; a central server computer communicating with said at least one gaming machine, said central server having associated therewith:

a bonus game unit configured for play of a bonus game in response to an outcome of the base game qualifying a player therefor, the bonus game comprises providing a qualified player at least one of an opportunity to participate in the bonus game and to return to the base game, the opportunity to participate in the bonus game comprises at least one player being challenged to a contest, the bonus game further providing the at least one player at least one of an opportunity to accept the challenge and to surrender, the at least one player having credits deducted upon surrender and awarded to a challenging entity, the at least one player accepting the challenge being followed by a conduct of the contest with the challenging entity, at least one of the at least one player and the challenging entity having credits awarded upon winning the contest.

46. The gaming system of claim 45, wherein the at least one gaming machine comprises a personal computer.

47. The gaming system of claim 46, wherein the personal computer is connected to the central server computer over the Internet.

* * * * *

UNITED STATES PATENT AND TRADEMARK OFFICE

CERTIFICATE OF CORRECTION

PATENT NO. : 6,902,478 B2
DATED : June 7, 2005
INVENTOR(S) : Monica A. McClintic It is certified that error appears in the above-identified patent and that said Letters Patent is hereby corrected as shown below:

Column 13,
Line 63, “the another” should be -- an another --.

Column 15,
Lines 51 and 55, “23” should be -- 22 --.

Signed and Sealed this

First Day of November, 2005

JON W. DUDAS
*Director of the United States Patent and Trademark Office*